US006554914B1

(12) United States Patent
Rozbicki et al.

(10) Patent No.: US 6,554,914 B1
(45) Date of Patent: Apr. 29, 2003

(54) PASSIVATION OF COPPER IN DUAL DAMASCENE METALIZATION

(75) Inventors: Robert T. Rozbicki, San Jose, CA (US); Ronald Allan Powell, San Carlos, CA (US); Erich Klawuhn, San Jose, CA (US); Michal Danek, Sunnyvale, CA (US); Karl B. Levy, Los Altos, CA (US); Jonathan David Reid, Sherwood, OR (US); Mukul Khosla, San Jose, CA (US); Eliot K. Broadbent, Beaverton, OR (US)

(73) Assignee: Novellus Systems, Inc., San Jose, CA (US)

( * ) Notice: Subject to any disclaimer, the term of this patent is extended or adjusted under 35 U.S.C. 154(b) by 12 days.

(21) Appl. No.: 09/776,704

(22) Filed: Feb. 2, 2001

(51) Int. Cl.[7] ..... C23C 8/24; C23C 8/08
(52) U.S. Cl. ..... 148/238; 148/282
(58) Field of Search ..... 148/238, 282

(56) References Cited

U.S. PATENT DOCUMENTS

| | | | | | |
|---|---|---|---|---|---|
| 4,588,490 | A | * | 5/1986 | Cuomo et al. | 204/298 |
| 5,009,963 | A | * | 4/1991 | Ohmi et al. | 428/472.2 |
| 5,084,412 | A | * | 1/1992 | Nakasaki | 437/189 |
| 5,298,091 | A | * | 3/1994 | Edwards, III et al. | 148/232 |
| 5,656,860 | A | * | 8/1997 | Lee | 257/751 |
| 5,969,422 | A | | 10/1999 | Ting et al. | |
| 6,046,108 | A | | 4/2000 | Liu et al. | |
| 6,077,780 | A | | 6/2000 | Dubin | |
| 6,114,238 | A | * | 9/2000 | Liao | 438/648 |
| 6,120,641 | A | * | 9/2000 | Stevens et al. | 156/345 |
| 6,147,000 | A | * | 11/2000 | You et al. | 438/687 |
| 6,159,857 | A | * | 12/2000 | Liu et al. | 438/687 |
| 6,280,597 | B1 | * | 8/2001 | Kashiwada et al. | 205/172 |
| 6,395,642 | B1 | * | 5/2002 | Liu et al. | 438/720 |
| 2002/0000382 | A1 | * | 1/2002 | Morrissey et al. | 205/115 |

OTHER PUBLICATIONS

M. Zinke–Allmang, "Phase Separation on Solid Surfaces: Nucleation, Coarsening and Coalescence Kinetics", Thin Solid Films, vol 346, 1999.

* cited by examiner

*Primary Examiner*—Roy King
*Assistant Examiner*—Harry D. Wilkins, III
(74) *Attorney, Agent, or Firm*—Beyer Weaver & Thomas, LLP

(57) ABSTRACT

The present invention pertains to systems and methods for passivating the copper seed layer deposited in Damascene integrated circuit manufacturing. More specifically, the invention pertains to systems and methods for depositing the copper seed layer by physical vapor deposition, while passivating the copper during or immediately after the deposition in order to prevent excessive oxidation of the copper. The invention is applicable to dual Damascene processing.

27 Claims, 8 Drawing Sheets

PASSIVATION OF COPPER IN DUAL DAMASCENE METALIZATION

CROSS-REFERENCE TO RELATED APPLICATIONS

This patent application is related to U.S. patent application Ser. No. 09/776,702, "Anti-Agglomeration of Copper in Integrated Circuit Metalization" filed by Rozbicki on the same date as this application, now U.S. Pat. No. 6,440,854. This patent application, along with all other patent applications, patents and publications are herein incorporated by reference in their entirety for all purposes.

FIELD OF THE INVENTION

The present invention pertains to systems and methods for passivating the copper seed layer deposited in Damascene integrated circuit manufacturing. More specifically, the invention pertains to systems and methods for depositing the copper seed layer by physical vapor deposition, while passivating the copper during or immediately after the deposition in order to prevent excessive oxidation of the copper. The invention is applicable to dual Damascene processing.

BACKGROUND OF THE INVENTION

Integrated circuit (IC) manufacturers have traditionally used aluminum and aluminum alloys, among other metals, as the conductive metal for integrated circuits. While copper has a greater conductivity than aluminum, it has not been used because of certain challenges it presents, including the fact that it readily diffuses into silicon oxide and degrades insulating electrical properties at very low doping concentrations. Recently, however, IC manufacturers have been turning to copper because of its high conductivity and electromigration resistance, among other desirable properties. Most notable among the IC metalization processes that use copper is Damascene processing.

Damascene processing is a method for forming metal lines on integrated circuits. It involves formation of inlaid metal lines in trenches and vias formed in a dielectric layer (inter-metal dielectric). A barrier layer that blocks diffusion of copper atoms is typically formed over the dielectric layer and underneath the metalization. Damascene processing is often a preferred method because it requires fewer processing steps than other methods and offers a higher yield. It is also particularly well-suited to metals such as Cu that cannot readily be patterned by plasma etching.

In a typical copper IC process, the formation of the desired conductive wires on the chip generally begins with a seed layer, usually deposited by physical vapor deposition (PVD). The seed layer provides a conformal, conductive layer on which a thicker layer of copper is electrofilled in order to fill in the features (e.g., trenches and vias) of the semiconductor wafer. One problem with the use of copper as the conductive metal is that it does not self-passivate, that is, it readily turns into copper oxide when exposed to oxygen. Unlike aluminum oxide, copper oxide does not protect the underlying metal. Rather it allows copper to continue to react until all the copper is converted to copper oxide. In Damascene processing, this can occur if the wafer is exposed to atmosphere, or if it is exposed to oxygen plasma during etch. It is a particularly acute problem when seed layers are involved. Copper seed layers are very thin, typically on the order of 1500 Å and as little as 50 Å on the bottoms and sidewalls of vias and trenches, and are therefore rapidly consumed.

What is needed therefore is a technique for protecting copper seed layers from oxidation.

SUMMARY OF THE INVENTION

The present invention pertains to systems and methods for passivating the copper seed layer deposited in Damascene integrated circuit manufacturing. More specifically, the invention pertains to systems and methods for depositing the copper seed layer by physical vapor deposition, while passivating the copper during or immediately after the deposition in order to prevent excessive oxidation of the copper. The invention is applicable to dual Damascene processing.

One aspect of the invention provides for a method for passivating a copper seed layer on an integrated circuit substrate. The copper is deposited by physical vapor deposition. The method incorporates nitrogen to form a passivating layer on the surface of the copper seed layer. The method may employ a hollow-cathode magnetron to deposit the copper. Regardless of the reactor chosen, the method preferentially employs a nitrogen gas or plasma. A separate annealing operation may or may not be carried out on the copper seed layer. The nitrogen can be introduced after PVD deposition in a separate reactor. The passivating layer may be pure $Cu_3N$. The method may be used in Damascene processing and dual Damascene processing. The method may also include controlled oxidation of the copper seed layer. This may be carried out before a copper fill or copper plating operation. The controlled oxidation may form 20–100 Å of copper oxide.

Another aspect of the invention provides for a method for passivating a copper seed layer on an integrated circuit substrate. The copper is deposited by physical vapor deposition. The method incorporates hydrogen to form a passivating layer on the surface of the copper seed layer. The method may employ a hollow-cathode magnetron to deposit the copper. Regardless of the reactor chosen, the method preferentially employs a hydrogen gas or plasma. No separate annealing operation need be carried out on the copper seed layer. The hydrogen can be introduced after PVD deposition in the same reactor or a separate reactor. The method may be used in Damascene processing and dual Damascene processing. The method may also include controlled oxidation of the copper seed layer. This may be carried out before a copper fill or copper plating operation. The controlled oxidation may form 20–100 Å of copper oxide.

Another aspect of the invention provides for a method for passivating a copper seed layer on an integrated circuit substrate. The copper is deposited by physical vapor deposition. The method incorporates a passivating agent to form a passivating layer on the surface of the copper seed layer. The passivating agent is chosen from the group comprising: $F_2$, $CF_4$, $Cl_2$, $SiH_4$ and Ge. The method may employ a hollow-cathode magnetron to deposit the copper. No separate annealing operation need be carried out on the copper seed layer. The passivating agent can be introduced after PVD deposition in a separate reactor. The method may be used in Damascene processing and dual Damascene processing. The method may also include controlled oxidation of the copper seed layer. This may be carried out before a copper fill or copper plating operation. The controlled oxidation may form 20–100 Å of copper oxide.

Another aspect of the invention provides for an apparatus module for physical vapor deposition of copper seed layer on an integrated circuit substrate in order to form a passivating layer on top of the copper seed layer, including a PVD chamber, a hollow-cathode magnetron, a copper target, a source of a neutral sputtering gas and a source of a passivating agent. The passivating agent may be nitrogen or hydrogen, or may be chosen from the group comprising: $F_2$, $CF_4$, $Cl_2$, $SiH_4$ and Ge. The apparatus is used to form part or all of a copper layer seed in a manner that passivates the copper. The apparatus may be used in Damascene or dual Damascene processing.

These and other features and advantages of the present invention will be described in more detail below with reference to the associated drawings.

DETAILED DESCRIPTION OF THE PREFERRED EMBODIMENTS

In the following detailed description of the present invention, numerous specific embodiments are set forth in order to provide a thorough understanding of the invention. However, as will be apparent to those skilled in the art, the present invention may be practiced without these specific details or by using alternate elements or processes. In other instances well-known processes, procedures and components have not been described in detail so as not to unnecessarily obscure aspects of the present invention.

A "semiconductor wafer" as referred to in this invention is a semiconductor substrate at any of the various states of manufacture in the production of integrated circuits. One standard semiconductor wafer described in this invention is 200 mm in diameter, 0.75 mm thick, with an approximate radius of curvature of about 0.15 millimeters (see SEMI Specification M1-0298). Of course, semiconductor wafers of other dimensions, such as a standard 300 mm diameter silicon wafers, can also be processed in accordance with this invention. Note that standard specifications for a 300 mm diameter wafer may be found in SEMI Specification M1.15-0997.

A "substrate surface" as referred to in this invention is any surface whereupon a seed layer is to be deposited. Substrate surfaces include, but are not limited to, semiconductor substrate surfaces in various states of manufacture, including surfaces on which the barrier layer has just been deposited.

The current invention is compatible with any sort of semiconductor manufacturing where a thin "seed" layer of copper must be deposited. This seed layer is typically deposited in preparation for deposition of a thicker electrofill layer. A particular semiconductor process that is compatible with the invention is Damascene processing, including dual Damascene processing, but the current invention is not limited to Damascene processing or semiconductor processing in general. The current invention is useful in many applications where a thin layer or layers of metal must be deposited.

Figure 1:
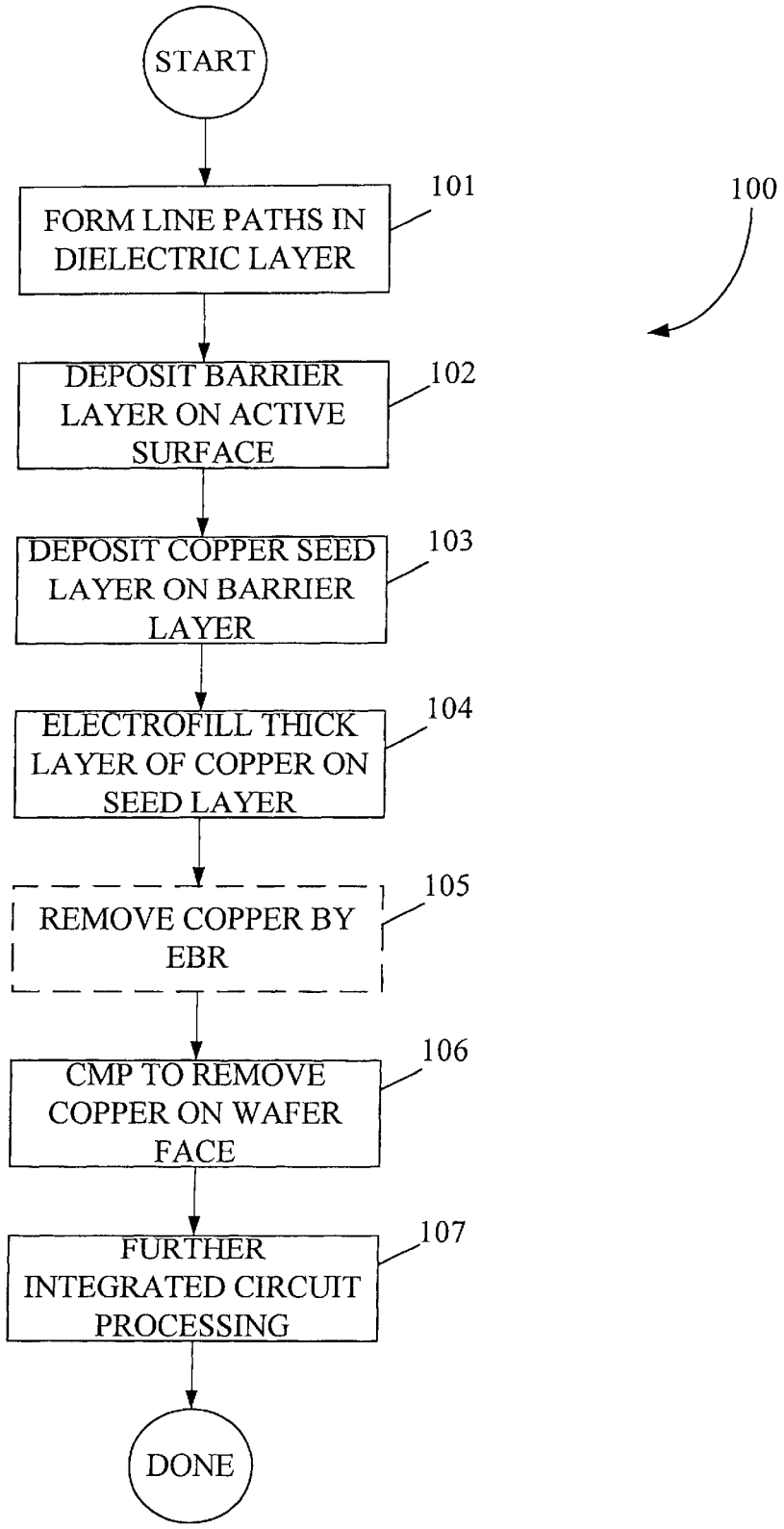
FIG. 1 is a process flow diagram illustrating relevant operations employed to form conductive copper lines by Damnascene processing.

A typical Damascene process flow 100 is illustrated in the flowchart of FIG. 1A in order to contextualize the present invention. Process 100 begins with formation of line paths in a previously formed dielectric layer. These line paths may be etched as trenches and vias in a blanket layer of dielectric such as silicon dioxide. The line paths define conductive routes between various devices on a semiconductor wafer. Because copper or other mobile conductive material provides the conductive paths of the semiconductor wafer, the underlying dielectric layers must be protected from metal ions (e.g., $Cu^{+}1$) that might otherwise diffuse into the silicon. To accomplish this, the process includes depositing a thin diffusion barrier layer 102 before depositing the metal. Suitable materials for the diffusion barrier layer include titanium, tantalum (Ta), tantalum nitride (TaN), tantalum nitride silicon (TaNSi), tungsten (W), titanium (Ti), titanium tungsten (TiW), titanium nitride silicon (TiNSi) and the like. The barrier layer is typically formed by a PVD process such as sputtering.

Before inlaying the line paths with the electrofill copper, a conductive surface coating must be applied. In the depicted process, this is accomplished by depositing a copper seed layer on the barrier layer at 103. This seed layer is deposited by a PVD process of the current invention, as will be discussed in detail below. Typically, the seed layer is deposited to a thickness of between about 300–2000 Å and more preferably between 1000–1500 Å on the planar areas and about 50 Å on the bottoms and sidewalls of vias and trenches. Next, as indicated at 104, a much thicker layer of copper is deposited on the seed layer by electroplating. The seed metal deposition and electrofill processes may leave metal deposited in unwanted areas. Such metal can be removed by the process of edge metal removal (EBR) 105, which is described in the U.S. patent application Ser. No. 09/557,668 filed by Mayer et al. on Mar. 25, 2000 titled "Edge Metal Removal of Copper from Silicon Wafers," now U.S. Pat. No. 6,309,981. This patent application is herein incorporated by reference in its entirety for all purposes.

After deposition of the copper is completed, the copper is planarized, generally by chemical-mechanical polishing (CMP) down to the dielectric at 106 in preparation for further processing (illustrated at 107), generally the addition of subsequent dielectric and metalization layers.

Dual Damascene processing is a subset process of Damascene processing wherein two layers of dielectric are laid down and then etched consecutively. The lower of the two layers is etched to define narrow vertical features such as vias that conductively couple lower and higher metalization layers, the upper of the two dielectric layers is etched to define the trenches in which horizontal metal lines are inlaid. This two-layer process facilitates the interconnecting of metal between two different layers of the integrated circuit.

Figure 2A:
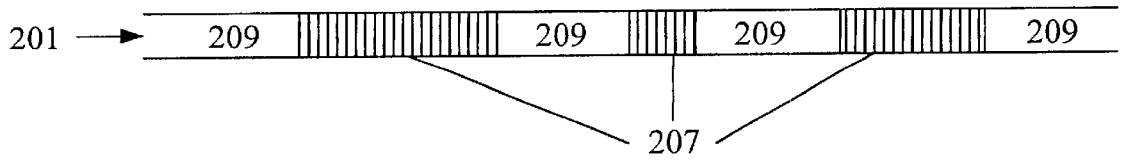
FIGS. 2A–2C schematically illustrate a Damascene metalization process.
Figure 2B:
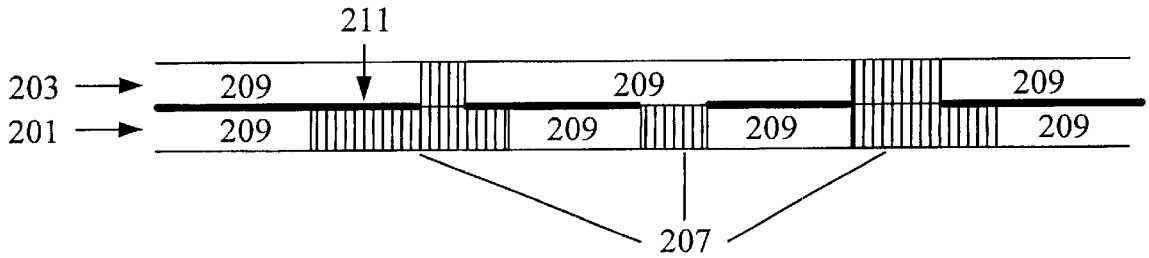
Figure 2C:
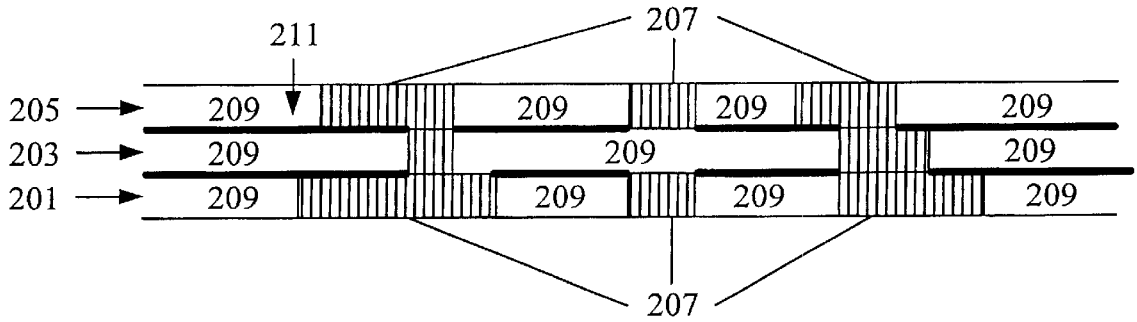

For context, FIGS. 2A–2C and 3A–3C schematically illustrate the Damascene and dual Damascene processes and contrasts the two. FIGS. 2A–2C illustrate the Damnascene process. FIG. 2A shows a first layer, 201, composed of copper metal 207 and dielectric 209. The dielectric was etched in the appropriate places to make room for metal deposition, which was deposited in the spaces by the process described in FIG. 1. FIG. 2B shows a second layer, 203, again with metal 207 and dielectric 209 deposited on the first layer 201. The etch stop 211 is shown between the first and second layer. The second layer serves as a via interconnect layer to conductively connect copper lines in the first and third layers. This layer is formed by the same Damascene process, as is the third layer as illustrated in FIG. 2C. Note that in this example the copper metal is in some places connected between all three levels.

Figure 3A:
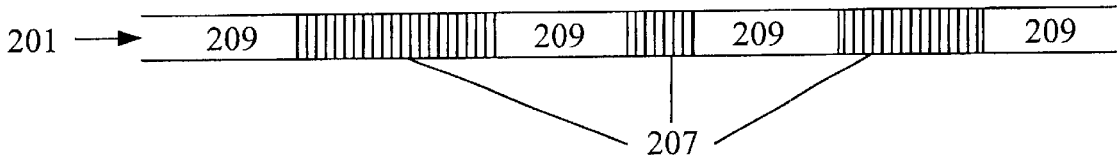
FIGS. 3A–3C schematically illustrate a dual Damascene metalization process.
Figure 3B:
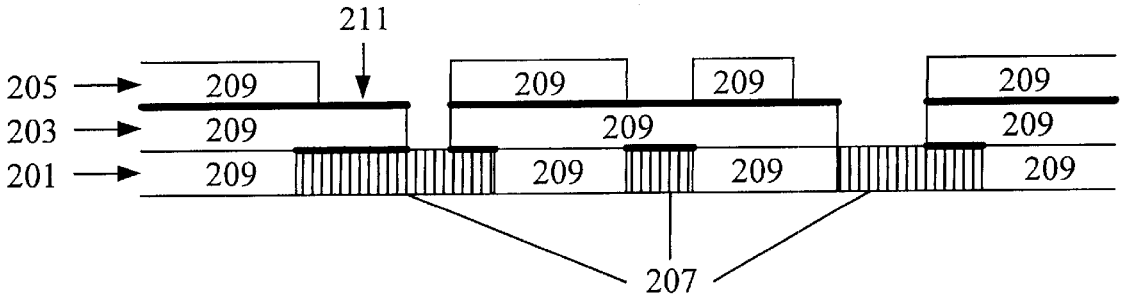
Figure 3C:
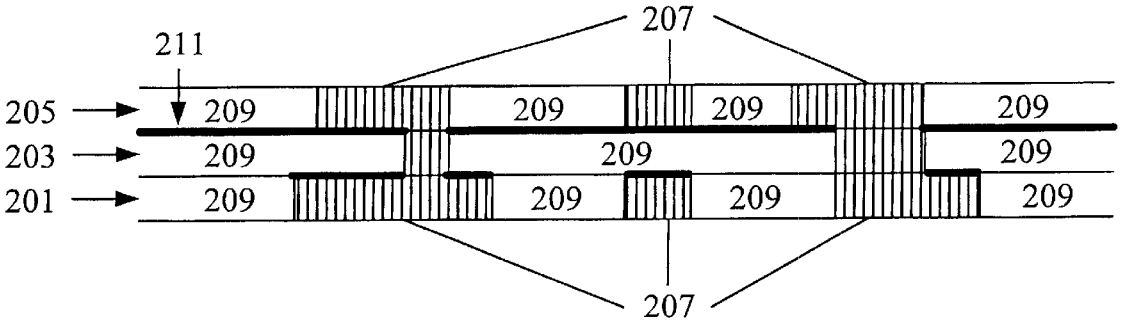

FIGS. 3A–3C illustrate the dual Damascene process that achieves the same end by a different intermediate operation. Thus FIG. 3A is identical to FIG. 2A and FIG. 3C is essentially identical to FIG. 2C. The process starts with layer one 201, and deposits two layers of dielectric (layers two 203 and three 205) right on top of each other before etching both of them. The etch stops 211, are also shown between the layers. See FIG. 3B. The copper metal 207, is then deposited in the etched spaces in both layers, thus yielding the three complete layers as illustrated in FIG. 3C. Note that in FIGS. 2A–2C and 3A–3C, ancillary layers such as the barrier layers and anti-reflective layers have been omitted for clarity's sake.

Figure 4A:
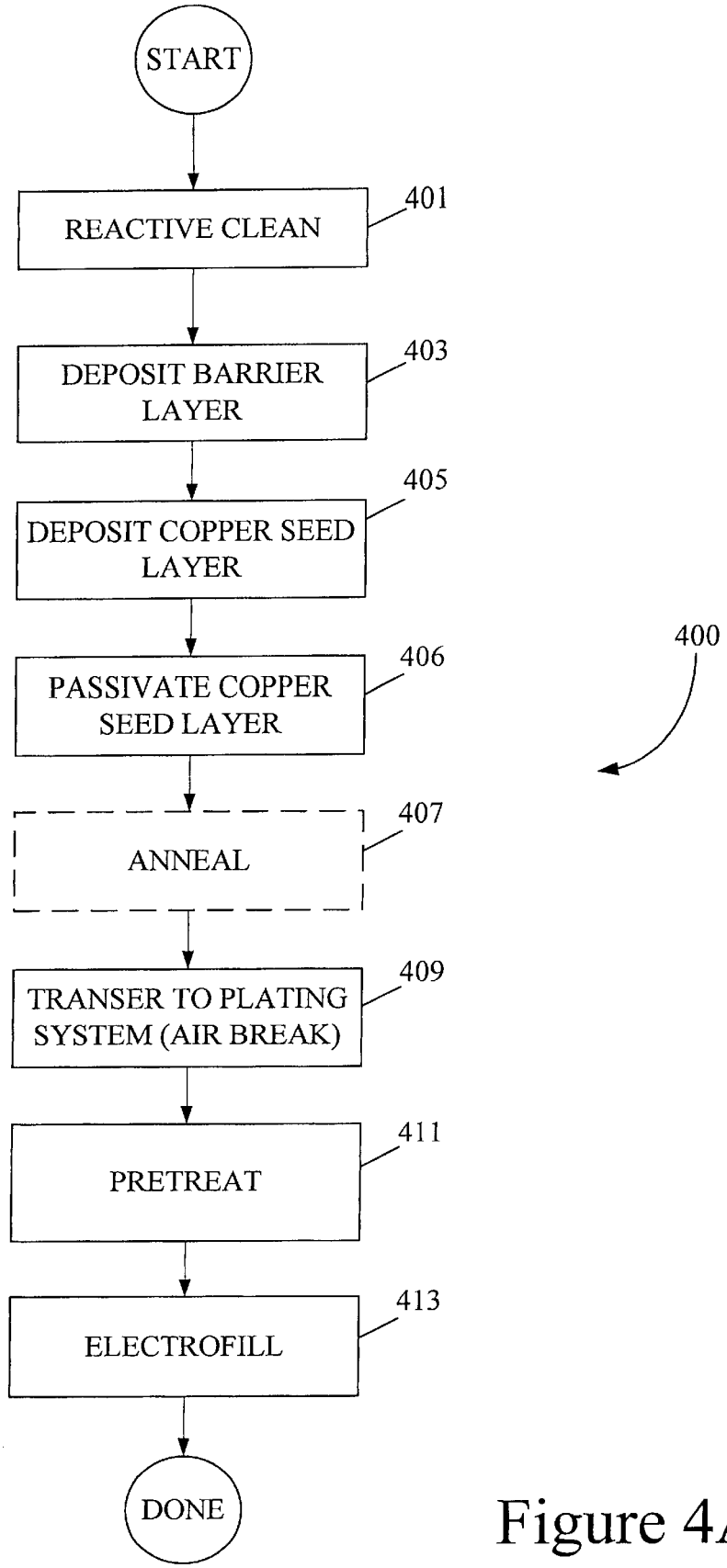
FIG. 4A is a process flow diagram illustrating relevant operations employed to deposit and passivate a copper layer according to the present invention.

A high-level description of a process 400 of the present invention is illustrated in the flowchart of FIG. 4A. Blocks 401 through 411 represent operations that may be subsumed within the general seed layer deposition operation 103 shown in FIG. 1. While this description is discussed in the context of a dual Damascene process, it is not limited to just this type of IC processing.

The invention is typically carried out on a dielectric substrate, as a sub-process in forming the first layer of metalization on the substrate, or a later metalization layer. In either case, the substrate will already have surface features such as vias and channels etched into the dielectric. In the latter case, the substrate will also include areas of electrofilled copper from the completed lower layers.

In either case, a cleaning operation is carried out to remove any unwanted materials, such as copper oxide, from the underlying electrofilled copper or conductive surface (e.g., polysilicon or metal silicide). See 401. This precleaning is typically done by a physical sputter etch of neutral gas plasma to remove the unwanted materials, and/or by a reactive cleaning which involves the use of an hydrogen-based plasma to reduce copper oxide back to copper. The precleaning also typically involves degassing, which also helps to remove unwanted materials.

Next, the barrier layer is deposited. See 403. The barrier layer is typically about 300 Å of a barrier material, such as tantalum, which is deposited by a PVD process such as hollow-cathode magnetron (HCM) PVD. The copper seed layer is then deposited by the process of the current invention. See 405. In a specific embodiment, the copper is deposited by an HCM PVD sputtering process. A preferred apparatus for carrying out this deposition is described in FIG. 5 below. An argon plasma provides argon ions that strike the copper target, which sputters copper atoms out into the chamber and onto the substrate surface, among other areas. In a preferred embodiment, the copper target is bombarded for about 10 to 60 seconds with an argon plasma produced from a flow of about 50 standard cubic centimeters per minute (SCCM) of argon. This results in a deposition of approximately 250–2500 Å of copper. In various embodiments, about 5–100 SCCM of argon plasma is used for about 20 to 100 seconds. More preferably, between about 20 and 50 SCCM of argon plasma is used for between about 20 and 40 seconds. The power used to generate the plasma is about 20 kW to 50 kW, more preferably about 36 kW.

HCM PVD uses a hollow metal cathode (target) rather than the flat target that is used in most PVD methods and a DC magnet coil instead of an RF magnet coil. In some cases, HCM PVD is preferable to other PVD methods because is achieves up to about 90% ionization of the copper atoms, rather than the mere 2% that is typical of other methods. Because of this ionization ratio, among other reasons, HCM provides more conformal coverage of the substrate surface. In a preferred embodiment, the semiconductor wafer is then moved to a separate passivation chamber where passivation is carried out. See 406. Since passivation is typically carried out with a non-neutral passivation agent such as hydrogen or nitrogen plasma, it is preferred to carry out this operation in a separate chamber so that agent does not negatively affect the metal target or the deposition process. In a preferred embodiment, about 10 SCCM of argon plasma and about 20 SCCM of hydrogen plasma are introduced into the apparatus for about 40 seconds. Note that the gases are typically mixed before they enter the apparatus chamber. The hydrogen can be provided from sources other than a hydrogen plasma source. For example, molecular hydrogen can be introduced into the reaction chamber and there converted to a hydrogen plasma. In various embodiments the amount of argon plasma used is about 1 to 100 SCCM and the amount of hydrogen plasma used is about 1 to 100 SCCM. More preferably, the amount of argon plasma used is 5 to 50 SCCM and the amount of hydrogen plasma used is about 5 to 50 SCCM. The power used to generate each of the plasma is about 500 to 1000 W, more preferably about 750 W. One example of an apparatus suitable for HCM PVD is the INOVA, available from Novellus Systems of San Jose, Calif.

Figure 4B:
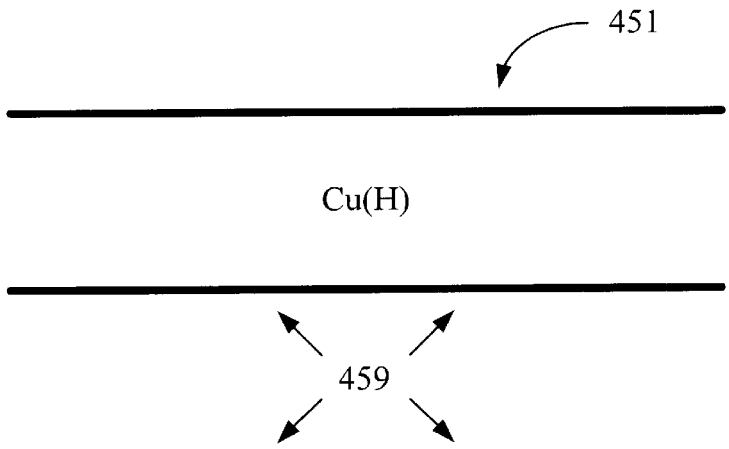
FIG. 4B is a schematic illustration of a copper seed layer passivated with hydrogen to form a single passivating layer.

In this preferred embodiment, the hydrogen is introduced into the copper seed layer after deposition, so that a single layer of copper with hydrogen trapped in it is created, as illustrated in FIG. 4B. See 451. The substrate 459 is illustrated underneath the copper seed layer. A similar layer of Cu(N) is created by the nitrogen-based passivation, as described below.

In another embodiment, the hydrogen-based passivation is carried out in the same chamber as the PVD deposition, after PVD deposition. In another embodiment, the hydrogen-based passivation is carried out during the PVD deposition, by applying hydrogen plasma at the same time as argon plasma. Therefore, while the PVD copper deposition 405 and the passivating operation 406 are preferably carried out as separate operations in separate chambers for the reasons discussed above, this is not a requirement of the invention.

While not wishing to be bound by theory, the inventors believe that the hydrogen is trapped in a top region of the copper seed layer and passivates it simply by reducing any copper oxide that forms immediately back to elemental copper. According to this theory, the degree of passivation should be limited by the amount of hydrogen trapped in the copper layer. And experiments have shown the passivating effect to be limited in time—about 24 hours at room temperature and 50% relative humidity, when the hydrogen passivation is carried out in the preferred embodiments as described. The passivation effect is shorter at higher temperatures.

Other passivating agents form a passivating layer on top of the copper that protects it from oxidation. Any such layer must prevent migration of the copper to the surface and diffusion of oxygen down into the copper. The layer should be made of a material that is easy to remove or convert back to copper, or that does not interfere with further IC processing. Nitrogen, for instance, can be used to form passivating layer of Cu(N). The notation Cu(N) indicates that nitrogen is incorporated into some or all of the copper seed layer. The notation indicates that some or all of nitrogen may be incorporated into the copper as the compound $Cu_3N$, but is not limited to this. Some nitrogen may be present in the copper in a non-covalently or ionically-bonded form.

In a preferred embodiment, the nitrogen-based passivation is implemented using a molecular nitrogen or nitrogen-based plasma gas source in a separate passivation chamber for the same reasons discussed above with the hydrogen passivation. In another embodiment, the nitrogen-based passivation is carried out in the same chamber as the PVD deposition, after PVD deposition. In another embodiment, the nitrogen-based passivation is carried out during the PVD deposition, by applying nitrogen-based plasma at the same time as argon plasma. The amounts of nitrogen plasma and exposure times used are approximately the same as described above for the hydrogen-based passivation, as is the power used to heat the plasma.

The nitrogen may be subsequently removed from the copper seed layer during pretreatment, as described below in 411, and/or during annealing of the copper seed layer. In preferred embodiments, the nitrogen is removed because Cu(N) has a higher resistivity than Cu, among other reasons. The compound $Cu_3N$ is unstable and is easily broken down into copper and nitrogen by heating. $Cu_3N$ may in fact revert to Cu at low temperatures such as room temperature, but the process occurs much faster upon heating.

Some other passivating agents that may be used with the invention include $F_2$ (which forms $CuF_2$ with the copper), $Cl_2$ (which forms $CuCl_2$), $SiH_4$ (which forms $Cu_3Si$ and $Cu_5Si$), and Ge (which forms $Cu_3Ge$). These passivating agents can be applied as gas plasmas, or in other forms.

In the processes of this invention, an active annealing operation is not required, but may be carried out at 407. Annealing is generically any operation performed at desired temperatures and atmosphere in order to facilitate processing, for example, to promote adhesion of the seed layer to the barrier layer, or to drive nitrogen out from the copper seed layer prior to electrofill.

The next operations in the flowchart, 409, 411 and 413, essentially correspond to the Damnascene electrofill operation 104 described above. The IC wafer, with its deposited seed layer, is transferred to a plating system, 409, to fill in a thicker layer of copper to complete the conductive routes. This operation typically involves an air break; that is, the IC wafer is exposed to air while it is being transferred to the plating system. This operation may also involve some storage time before the wafer is placed in the plating system, which also typically involves exposure to air. In either case, an unpassivated copper seed layer is susceptible to oxidation.

The pretreat operation 411 could also involve reduction of copper oxide back to copper, due to the air break. However, it has been found that a small amount of copper oxide, about 40 Å, is most desirable as a starting point for the plating operation 413. Either more or less copper oxide results in less optimal plating. If some oxidation of the copper is necessary, this oxidation is typically carried out by an oxygen plasma, which oxidizes the copper in a rapid and controllable manner. If too much copper oxide has been developed, some of this could be reduced back to copper with a reducing plasma such as hydrogen. However, this is somewhat problematic as this would leave a layer of pure copper on top of the desired 40 Å copper oxide layer that is desirable for electrofill. Another option is to reduce all of the copper oxide and then reform 40 Å of copper oxide, but this would be time-consuming. Therefore, it is generally preferred to arrange the operations for FIG. 4A so that 40 Å or slightly less is formed during the air break. After electrofill 413, the copper metal is then planarized in preparation for further IC processing, such as additional layers of metalization as described in FIG. 1.

In the case of passivation by hydrogen, oxidation of the copper and removal of the hydrogen is accomplished by the same process. In the case of passivation by nitrogen, simple heating removes the nitrogen by breaking down the unstable $Cu_3N$ compound and outgassing the nitrogen. Heating also can facilitate oxidation of the copper when carried out in a controlled manner. It may be that during the interim period between operations 409 and 411 that the amount of copper oxide that has been formed is greater than the optimal amount. Of course, a main purpose of the current invention is to create a passivating layer that protects the copper from oxidation, and preferably the layer is formed in such a manner so that at the end of the air break it will have approximately, or slightly less than, the desired amount of copper oxide. After electrofill 413, the copper metal is then planarized in preparation for further IC processing, such as additional layers of metalization as described in FIG. 1.

Figure 5:
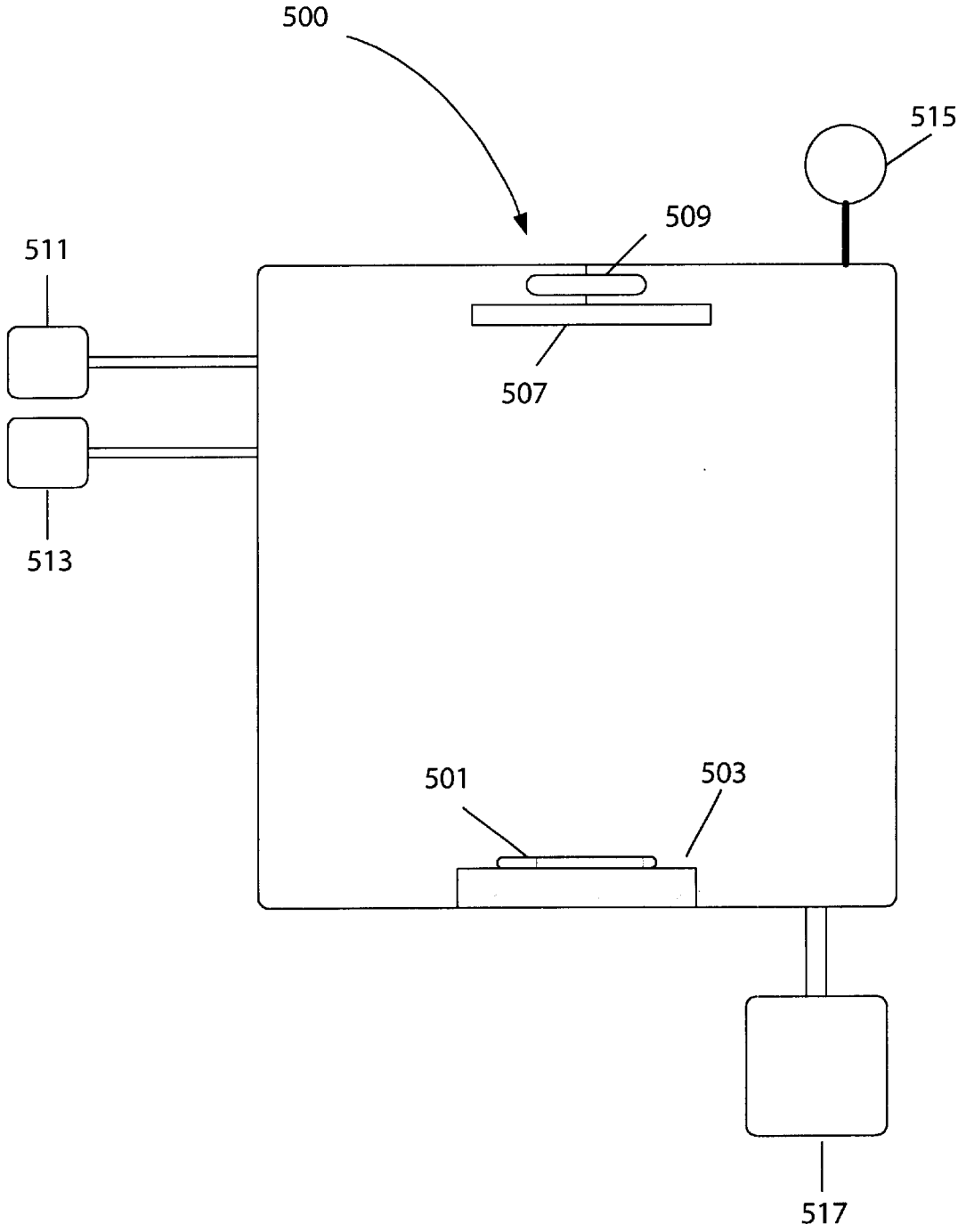
FIG. 5 is a schematic illustration showing a apparatus PVD chamber suitable for practicing the present invention.

FIG. 5 depicts a PVD system 500, in which the invention may be practiced. Inside the apparatus chamber, the semiconductor wafer 501, sits on top of a supporting pedestal 503. The supporting pedestal 503 has a thermocouple or other temperature sensing mechanism attached to it to precisely monitor the temperature of the wafer. The wafer can be cooled by any number of commonly-known methods. In a preferred embodiment, the wafer is placed on a table that is maintained at a cool temperature, and is also exposed on its bottom-side to a cool neutral gas such as Ar at 7 torr.

The apparatus includes a copper target 507 and magnets for directing the copper ions 509. FIG. 5 shows an argon source 511 and a passivating agent source 513. The two sources 511 and 513, preferably plasma gas sources, can be introduced through different lines as shown, or through the same line. The flow rate from each of these sources can be controlled separately. If introduced as gas, they must be converted to plasma within system 500. The system also includes a pressure gauge 515 and a pump 517 for controlling the flow of gases. A plating system that can be used with the invention is the SABRE plating system, available from Novellus Systems of San Jose, Calif.

Various experiments were conducted to demonstrate the advantages provided by certain aspects of this invention. It should be understood that the experiments described in the following examples are representative only and in no way limit the scope of the present invention. In the following experiments, copper seed layers were deposited and passivated according to certain preferred embodiments of the present invention. First an unprocessed silicon dioxide semiconductor wafer was degassed at 350° C. for 40 seconds. Next 300 Å of tantalum barrier was deposited in an HCM barrier deposition chamber. Next, 1500 Å of the copper seed layer was deposited in an HCM PVD chamber.

The semiconductor wafer was then moved to the passivation chamber and treated in one of three different ways, depending on what experimental group it was in. The RF source power used to heat the plasma in this chamber was operated at 750 W and there was no bias on the pedestal (substrate). The hydrogen group was treated with 20 SCCM of hydrogen and 10 SCCM of argon for 40 seconds. The nitrogen group was treated with 20 SCCM of nitrogen and 10 SCCM of argon for 40 seconds. The control was simply held in the passivation chamber for 40 seconds.

Figure 6A:
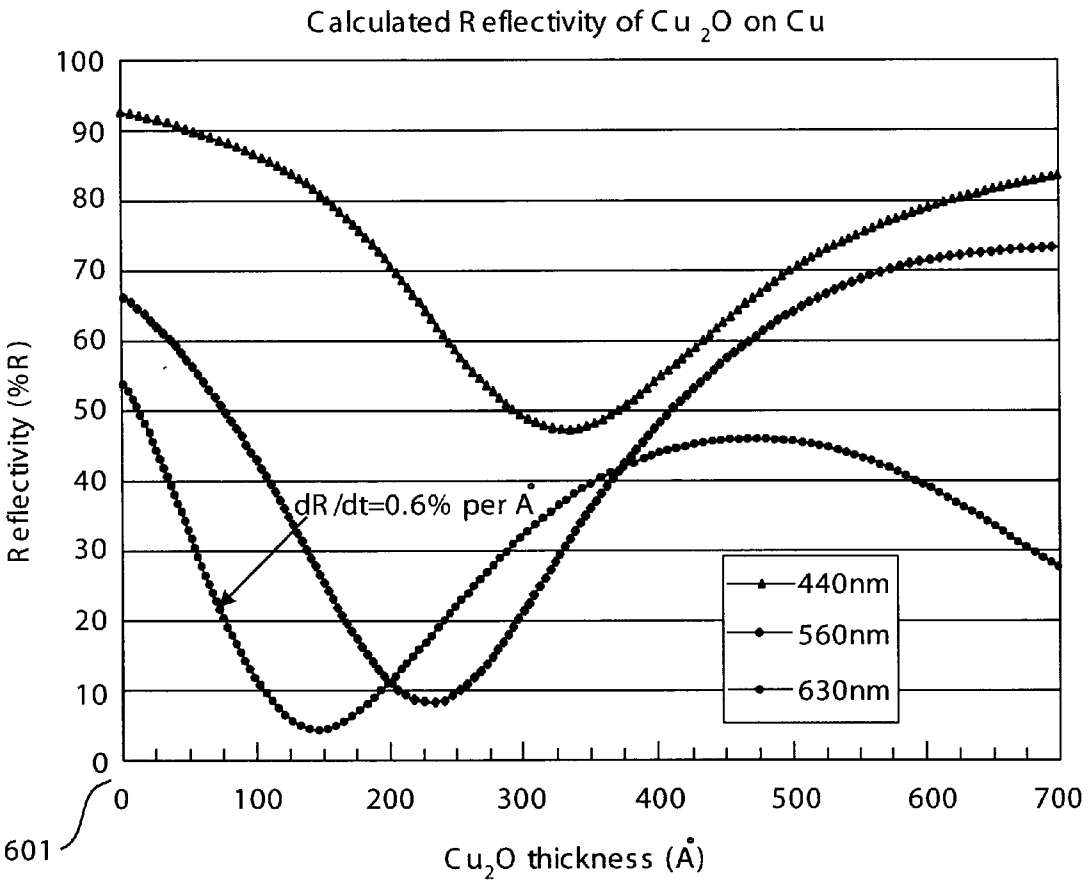
FIG. 6A illustrates the reflectivity of $Cu_2O$ at wavelengths of 440, 560 and 630 nm.
Figure 6A:
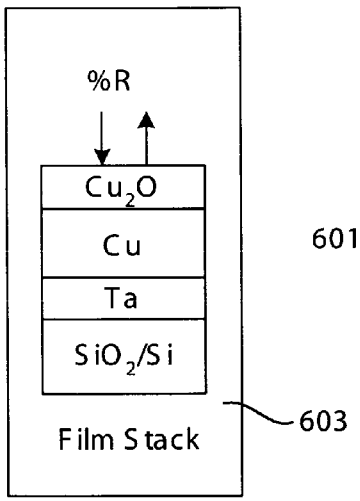
Figure 6B:
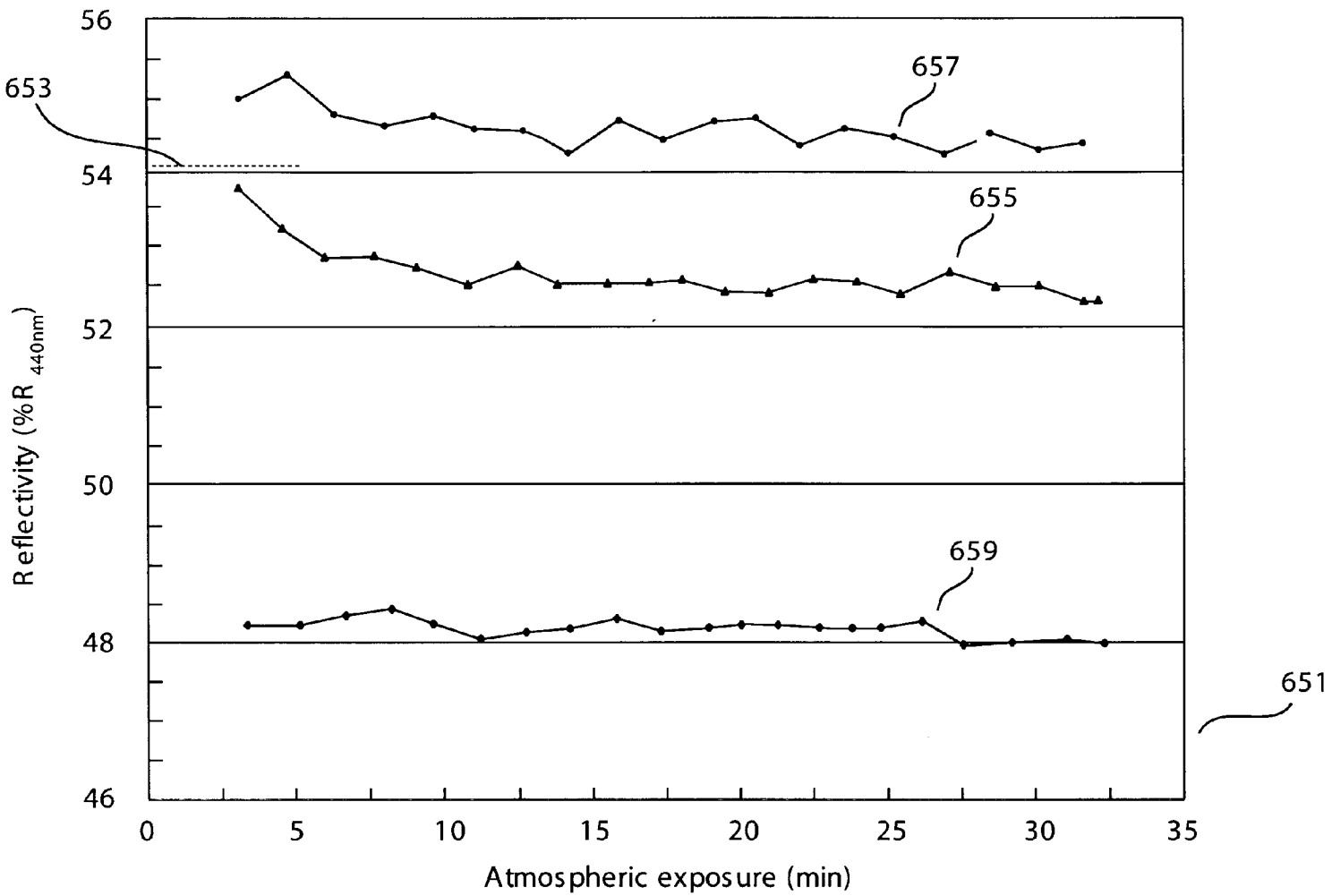
FIG. 6B illustrates experimental results, showing the amount of copper oxide based on reflectivity measurements at 440 nm.

The graphs of FIGS. 6A and 6B illustrates the results of these experiments. FIG. 6A shows the known reflectivity of $Cu_2O$ of different thicknesses, at wavelengths of 440 nm, 560 nm and 630 nm. See 601. These measurements were taken by the inventors on a $Cu_2O$, Cu, Ta and $SiO_2$/Si film stack as illustrated in 603. The reflectivity at 440 nm was used for these experiments. When the thickness of $Cu_2O$ is 0, the reflectivity at 440 nm is 54.2%. The change in reflectivity over thickness, dR/dt, is about 0.6% in the linear range between 1 and 100 Å.

In the experimental series, it took three minutes to transfer semiconductor wafers from the INOVA tool to the reflectance measurement tool, which was a Prometrix FT700, available from Jandel Engineering Limited, of Linslade, England. These measurements were carried out at room temperature and humidity. Beginning at time=3 minutes, reflectivity measurements were taken at five different points on the wafer every 90 seconds. The results are shown in graph 651. The control wafer, represented by curve 655, which was not treated with a passivating agent, had a reflectivity of 53.80% at 3 minutes, which decreased to 52.40% at 31 minutes. The wafer treated with hydrogen, represented by curve 657, had a reflectivity of 54.90% at 3 minutes, which decreased to 54.41% at 31 minutes. Thus the amount of oxide formed on the hydrogen wafer was clearly less than that formed on the control wafer. A large amount of the control wafer oxidation took place during the first three minutes, since the reflectivity/copper oxide levels on the hydrogen wafer and the control wafer should have been the same at t=0, yet the reflectivity at 3 minutes already diverged by 1.10% between the two.

The reflectivity for the hydrogen wafer at 3 minutes was 54.90%, which is higher than the theoretical limit derived of 54.20% (indicated by 653). This discrepancy was probably due to a difference in the surface morphology between the tested wafers and the experimental stack used to derive the reflectance standards, or perhaps due to a small amount of copper hydride that formed on the hydrogen wafer. What is key is that the reflectance of the hydrogen wafer changed much less than that of the control wafer both during the measured time and probably in the first three minutes. The nitrogen-treated wafer, represented by curve 659, showed a very small change in reflectance, from 48.2% at 3 minutes to 48.0% at 31 minutes, also indicating slow oxidation of the copper. The reflectance standards for copper nitride/copper oxide were not known by the inventors at the time of filing.

A detailed description of methods and systems for deposition copper seed layers in a manner that is compatible with the present invention and that reduces agglomeration of the copper seed layer can be found in U.S. patent application Ser. No. 09/776,702, "Anti-Agglomeration of Copper in Integrated Circuit Metalization", now U.S. Pat. No. 6,440,854, which is herein incorporated by reference in its entirety for all purpose. The methods and systems of that invention are compatible with those described in this patent application, and can typically be practiced simultaneously with this invention.

Although various details have been omitted for clarity's sake, various design alternatives may be implemented. Therefore, the present examples are to be considered as illustrative and not restrictive, and the invention is not to be limited to the details given herein, but may be modified within the scope of the appended claims.

What is claimed is:

1. A method of passivating a copper seed layer on an integrated circuit surface substrate, the method comprising:

physical vapor deposition of copper onto the substrate surface to form the copper seed layer;

incorporating nitrogen into the copper seed layer, so that a passivating layer is formed on the surface of the copper seed layer; and depositing a second copper layer over the copper seed layer, wherein the method further provides for controlled oxidation of the copper seed layer so that a layer of copper oxide is formed.

2. The method of claim 1 wherein the copper is deposited by hollow-cathode magnetron physical vapor deposition.

3. The method of claim 1 wherein the incorporating is implemented with a gas plasma.

4. The method of claim 1 wherein the incorporating is implemented by exposing the copper seed layer to the nitrogen after physical vapor deposition, in the same chamber.

5. The method of claim 1 wherein no separate annealing of the copper seed layer operation is carried out.

6. The method of claim 1 wherein the passivating layer comprises pure $Cu_3N$.

7. The method of claim 1 wherein the integrated circuit surface includes an etched dielectric layer used in Damascene processing.

8. The method of claim 7 wherein the etched dielectric layer comprises two separate dielectric layers used in dual Damascene processing.

9. The method of claim 1 wherein the controlled oxidation is performed before a copper fill or copper plating operation.

10. The method of claim 1 wherein the controlled oxidation forms about 20–100 Å of copper oxide.

11. A method of passivating a copper seed layer on an integrated circuit surface substrate, the method comprising:

physical vapor deposition of copper onto the substrate surface to form the copper seed layer;

incorporating hydrogen into the copper seed layer, so that a passivating layer is formed on the surface of the copper seed layer; and depositing a second copper layer over the copper seed layer, wherein the method further provides for controlled oxidation of the copper seed layer so that a layer of copper oxide is formed.

12. The method of claim 11 wherein the copper is deposited by hollow-cathode magnetron physical vapor deposition.

13. The method of claim 11 wherein the incorporating is implemented with a gas plasma.

14. The method of claim 11 wherein the incorporating is implemented by exposing the copper seed layer to the hydrogen after physical vapor deposition, in the same chamber.

15. The method of claim 11 wherein no separate annealing of the copper seed layer operation is carried out.

16. The method of claim 11 wherein the integrated circuit surface includes an etched dielectric layer used in Damascene processing.

17. The method of claim 16 wherein the etched dielectric layer comprises two separate dielectric layers used in dual Damascene processing.

18. The method of claim 11 wherein the controlled oxidation is performed before a copper fill or copper plating operation.

19. The method of claim 11 wherein the controlled oxidation forms about 20–100 Å of copper oxide.

20. A method of passivating a copper seed layer on an integrated circuit surface substrate, the method comprising:

physical vapor deposition of copper onto the substrate surface to form the copper seed layer;

incorporating a passivating agent into the copper seed layer, so that a passivating layer is formed on the surface of the copper seed layer, wherein the passivating agent is selected from a group consisting of: $F_2$, $CF_4$, $Cl_2$, $SiH_4$ and Ge; and depositing a second copper layer over the copper seed layer, wherein the method further provides for controlled oxidation of the copper seed layer so that a layer of copper oxide is formed.

21. The method of claim 20 wherein the copper is deposited by hollow-cathode magnetron physical vapor deposition.

22. The method of claim 20 wherein the incorporating is implemented by exposing the copper seed layer to the passivating agent after physical vapor deposition, in the same chamber.

23. The method of claim 20 wherein no separate annealing of the copper seed layer operation is carried out.

24. The method of claim 20 wherein the integrated circuit surface includes an etched dielectric layer used in Damascene processing.

25. The method of claim 24 wherein the etched dielectric layer comprises two separate dielectric layers used in dual Damascene processing.

26. The method of claim 20 wherein the controlled oxidation is performed before a copper fill or copper plating operation.

27. The method of claim 20 wherein the controlled oxidation forms about 20–100 Å of copper oxide.

* * * * *